United States Patent [19]

Steinbach

[11] Patent Number: 4,821,539

[45] Date of Patent: Apr. 18, 1989

[54] KEEPER LOCK FOR SLIDE FASTENER

[75] Inventor: Robert Steinbach, Glendale Heights, Ill.

[73] Assignee: Chicago Lock Company, Chicago, Ill.

[21] Appl. No.: 199,149

[22] Filed: May 26, 1988

[51] Int. Cl.[4] ..... E05B 67/38

[52] U.S. Cl. ..... 70/68

[58] Field of Search ..... 70/68, 208, 360, 361, 70/216, 217, 221, DIG. 20, DIG. 27

[56] References Cited

U.S. PATENT DOCUMENTS

| | | | |
|---|---|---|---|
| 1,703,338 | 2/1929 | Devereaux | 70/216 |
| 3,580,016 | 5/1971 | Kerr | 70/68 |
| 3,653,236 | 4/1972 | Kerr | 70/68 |
| 3,735,613 | 5/1973 | Diebel et al. | 70/208 |
| 3,785,185 | 1/1974 | Kerr | 70/68 |
| 4,677,833 | 7/1987 | Scherbing et al. | 70/68 |
| 4,689,976 | 9/1987 | Larsen | 70/208 |

FOREIGN PATENT DOCUMENTS

| | | | |
|---|---|---|---|
| 1461481 | 11/1966 | France | 70/208 |

*Primary Examiner*—Lloyd A. Gall

*Attorney, Agent, or Firm*—Basil E. Demeur; Robert E. Knechtel; Alan B. Samlan

[57] ABSTRACT

An improved keeper lock for a zipper-type slide fastener. The lock includes a barrel assembly of a tubular barrel and an anvil fixed to and projecting readily from the barrel, the anvil adapted to receive the slide fastener when the fastener is moved to its closed position. A key operated lock assembly is telescopically and rotatably received in the barrel for limited axial sliding movement. A keeper arm is fixed to and projects radially from the lock assembly adjacent to a proximal end of it and the lock assembly and keeper arm are capable of both angular rotation and axial movement so that it may assume a fully telescoped locked position with the keeper arm closely overlying the anvil for confining the slide fastener between the keeper arm and the anvil. It may also assume an unlocked position wherein the keeper arm overlies the anvil and is spaced apart therefrom. The improvement includes means to align the keeper arm over the anvil when the keeper arm is in a partially telescoped and unlocked position such that it may assume a fully telescoped locked position with the keeper arm closely overlying the anvil by applying an axial force to the keeper arm. The alignment means includes an upstanding finger arm, a slidable locking bolt which engages a groove in the barrel.

9 Claims, 1 Drawing Sheet

FIG. 1
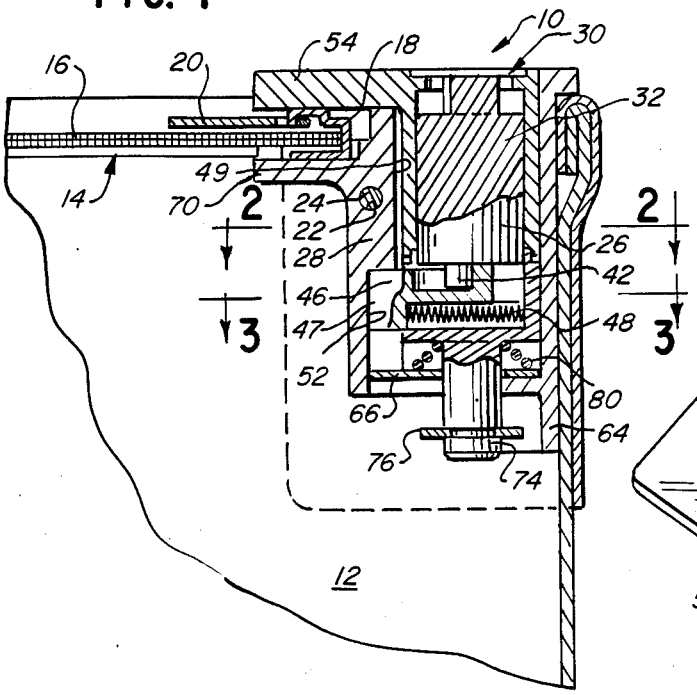
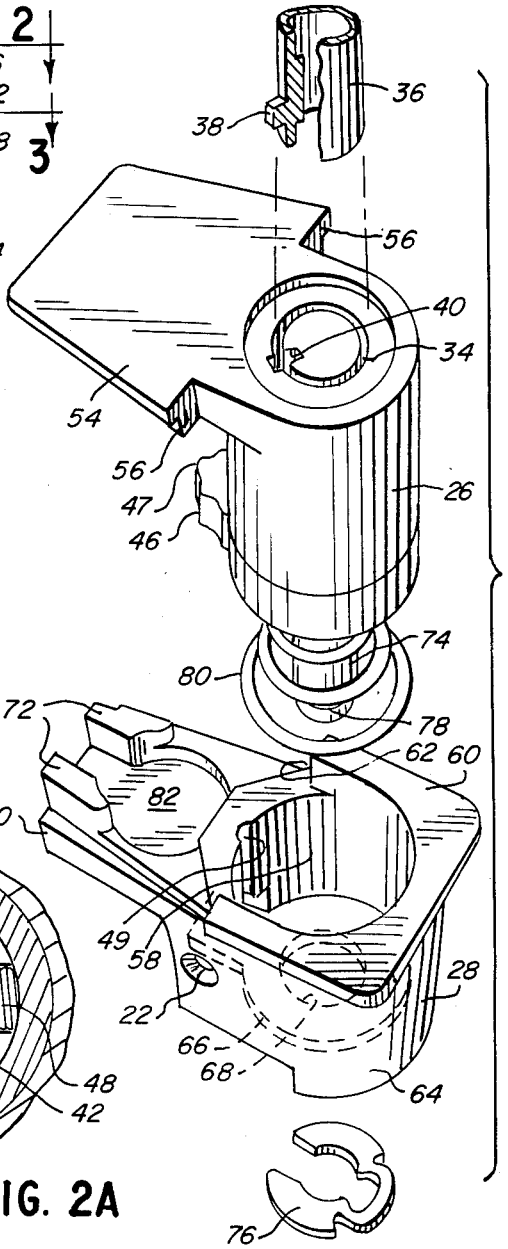
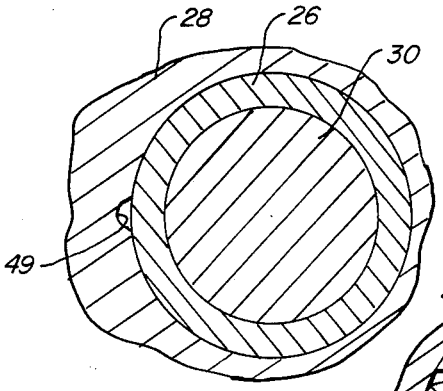
FIG. 2
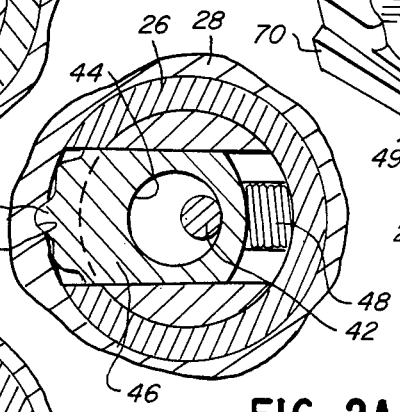
FIG. 2A
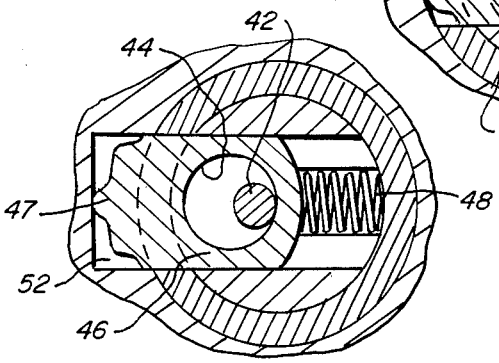
FIG. 3
FIG. 4

KEEPER LOCK FOR SLIDE FASTENER

BACKGROUND AND SUMMARY OF THE INVENTION

This invention relates to a keeper lock for a zipper-type slide fastener and, more particularly, is related to a key-operated keeper lock having a keeper flange and anvil portion which lock therebetween a pull tab on a locking strip.

Keeper locks, commonly referred to as bag locks, are designed for use in connection with a slide fastener or zipper which closes the opening of a flexible money bag. The lock consists of two principal parts, namely, a lock barrel and a concentric lock cylinder. The lock barrel has an anvil portion which underlies the pull tab of the slide fastener when the pull tab is in its closed position. The lock cylinder carries a keeper flange which can be rotated to lie directly over the anvil when the pull tab is in its closed position. The anvil has retainer flanges that securely hold the pull tab between the anvil and keeper flange when in its locked position.

Generally, the keeper lock is designed with the keeper flange mounted to the housing of the lock cylinder such that the housing is telescopically received in the barrel assembly so that it can be shifted radially and axially. Thus, the keeper flange can be moved telescopically and shiftable axially with respect to the barrel so that the keeper flange may be initially separated from its position of closely overlying the anvil portion and, thereafter, be rotated to an out-of-the-way position in order to permit the pull tab of ths slide fastener to be removed from its captive position on the anvil.

A slidable locking bolt protrudes from the lock housing into the barrel assembly which locks the keeper arm in position above but closely associated with the anvil portion. Generally, the locking bolt and its associated lock barrel are designed so that the bolt will not lock the keeper arm from rotating with respect to the barrel in any position other than when the keeper arm is in its fully locked position with the keeper arm in a fully telescoped position and closely overlying the anvil. Also, many of the prior art locks were designed so that the removal of the key from the lock cylinder was prevented except with the keeper flange in its locked position. In such locks the key had to remain in the lock at all times while the lock was in its opened position.

One example of a prior art lock is illustrated in U.S. Pat. No. 3,580,016. The problem with this lock is that it does not provide any means to accurately and securely position the keeper flange directly over the anvil. With the keeper flange in its unlocked position, it is free to rotate in a complete 360° circle. The same problem occurs in the locks illustrated in U.S. Pat. Nos. 4,249,402; 4,019,353; and 3,785,185.

It has been found to be a great advantage to users of these locks to have means to accurately position the keeper arm directly above yet spaced apart from the anvil when the keeper arm is in its unlocked position. The lock user has found it advantageous to be able to remove the key from the tumbler and accurately position the keeper flange directly over the anvil. If the keeper arm can be properly and definitively aligned over the anvil, all that is required to lock the keeper flange in close proximity to the anvil is to push the keeper arm axially towards the anvil until it assumes a fully telescoped locked position. In such a position, the keeper arm closely overlies the anvil and confines the slide fastener between the keeper arm and the anvil in a locking relationship.

Accordingly, it is an object of the present invention to provide a keeper lock having means to accurately position the keeper flange directly over the anvil in proper alignment with the anvil so that in order to confine the slide fastener between the arm and anvil all that is required is to push the keeper arm in an axial direction towards the anvil until the locking bolt engages a locking recess in the lock barrel.

It is yet another object to provide a keeper lock having a slidable locking bolt with an upstanding finger which engages a groove in the barrel assembly such that the finger and groove cooperate to provide the necessary alignment means.

It is another object to provide such a keeper lock so that the key may be removed from the lock assembly when the lock is in either its locked or unlocked position.

The present invention consists of a keeper lock wherein the lock has a barrel assembly and an anvil affixed to and projecting radially from the barrel. The anvil is adapted to receive the slide fastener when the fastener is moved to its closed position. A key operated lock assembly telescopically and rotatably is received in the barrel for limited axial sliding movement and has a keeper arm affixed to and projecting radially from the lock assembly. The lock assembly and keeper arm are capable of both angular rotation and axial movement. The keeper arm may assume any one of three positions. In one position, the keeper arm is fully telescoped and locked with the keeper arm closely overlying the anvil for confining the slide fastener between the keeper arm and the anvil. In a second or intermediate position, the keeper arm is partially telescoped and unlocked with the keeper arm overlying the anvil but spaced apart from it. In the third or unlocked position, the keeper arm is swung to one side so that it assumes a laterally removed position with respect to the anvil so that the slide fastener is accessible for manipulation. There is a locking bolt carried by the lock assembly and adapted for locking the lock assembly to the barrel when the lock assembly assumes the fully telescoped locked position. A lock cylinder in the lock assembly is movable between locked and unlocked positions and a key and tumbler mechanism controls the operation of the cylinder. The operation of the lock cylinder serves to withdraw the locking bolt from its locking engagement with the barrel. An improvement comprises an upstanding finger extending from the locking end of the locking bolt which engages a complimentary groove in the barrel when the two are in proper alignment. Alignment occurs when the keeper arm or flange is positioned directly above the anvil. The upstanding finger on the locking bolt engages the groove and retains the keeper arm directly above the anvil portion until the key is used to withdraw the locking bolt which in turn withdraws the upstanding finger from the groove.

BRIEF DESCRIPTION OF THE DRAWINGS:

FIG. 1 is a fragmentary side view partially in cross section and with portions removed of the keeper lock in its fully locked position and securing a pull tab for a slide fastener.

FIG. 2 is a horizontal sectional view taken along line 2—2 of FIG. 1 with portions removed with the lock in its fully locked position.

FIG. 2A is a horizontal section view similar to FIG. 2, taken along line 2—2 of FIG. 1 with portions removed, when the lock is in a partially telescoped and unlocked position.

FIG. 3 is a horizontal sectional view taken along line 3—3 of FIG. 1 with portions removed.

FIG. 4 is an exploded perspective view of the keeper lock.

DETAILED DESCRIPTION OF THE PREFERRED EMBODIMENT

Turning first to FIG. 1, there is illustrated a keeper lock 10 secured within a flexible money bag 12. The money bag 12 is of the generally used type for transporting money or valuable documents from one location to another and wherein it is necessary that the bag be able to be locked in its closed position. Generally, the bag 12 is of the envelope type design made of canvas or other strong cloth material and is folded upon itself in order to provide a two-sided envelope having folded side edges, a fully stitched bottom, and an opened top remaining unstitched in order to provide an entrance opening which is generally adapted to be closed with a conventional slide fastener or zipper 14. The zipper 14 has locking strips 16 which are designed for interlocking engagement with each other under the control of a sliding element 18 drawn by a pull tab 20. As such, the zipper 14 operates in its conventional manner.

As can be seen in FIG. 1, the slide fastener or zipper 14 terminates short of the upstanding side edge of the bag 12, thus leaving a small gap or void area in the upper corner of the bag. This serves as the location where the keeper lock 10 is received. The keeper lock 10 has a transverse bore 22 adapted to receive a rivet or screw 24 which passes through the bag 12 and retains the keeper lock 10 in its proper position which is in a top corner of the bag 12.

As can be seen in FIG. 4, the keeper lock 10 is comprised of essentially two main removable portions: a lock housing 26 and a barrel assembly 28. Within the lock housing 26 is a key operated tubular lock assembly 30 having a lock cylinder 32.

The key operated tubular lock assembly 30 is fairly standard in design and commonly known in the industry. There is a channel 34 which receives a tubular key 36. There is a key tab 38 on the key 36 which must be aligned with a keyway 40 located in the channel 34. When the proper key 36 is inserted into the tubular lock assembly 30, and when the key is rotated, it causes an eccentric pin 42 located at the distal end of the lock housing 26 to rotate.

As seen in FIGS. 1 and 3, the eccentric pin 42 engages a circular notch 44 cut in a slidable locking bolt 46. A compression spring 48 has one end abutting the locking housing 26 and its other end engaging the slidable locking bolt 46. The end of the bolt 46 opposite the compression spring 48 extends through a slot in the sidewall 50 and into a bolt receiving pocket 52 cut into the barrel assembly 28. The pocket 52 is designed for receiving the bolt 46 in a locking relationship. The bolt 46 is urged into the pocket 52 by means of the compression spring 48 such that when the two are in alignment and the eccentric pin permits the bolt 46 to extend therein, the bolt 46 will be received into the pocket 52.

The lock housing 26 is also provided with a keeper arm or flange 54 extending radially outward therefrom at its proximal end. The keeper flange 54 has opposite shoulders 56 which define the point where the keeper flange 54 joins the lock housing 26. As shown in FIGS. 1 and 4 of the drawings, the keeper flange 54 fully overlies the sliding element 18 when the keeper lock 10 is in the fully locked position. In this position, the sliding element 18 is located in the pocket 82 which is immediately rearward of the retainer flanges 72. The pull tab 20 extends outwardly therefrom between the retainer flanges 72, such that the pull tab 20 is prevented from sliding motion to the left to unzip the zipper. This construction is standard in the art and is well known to those skilled in the art.

The barrel assembly 28 has an internal bore 58 which closely receives the lock housing 26. At the top portion of the barrel assembly 28 is a rim flange 60 which is generally of a U-shape with end walls 62. At the bottom of the barrel assembly 28 is a shank portion 64 which may be provided with a rivet receiving hole (not illustrated) to secure the keeper lock 10 to the bag 12. Lying horizontally across the bottom of the barrel assembly 28 is a closure plate 66 having a central open washer portion 68. There is an anvil portion 70 extending radially from the barrel assembly 28. A pair of retainer flanges 72 securely hold the pull tab 20 when the pull tab is in its locked position.

The slidable locking bolt 46 has an upstanding finger 47 at its distal end. There is a groove 49 longitudinally cut in the bore 58 of the barrel assembly 28. The groove 49 is dimensioned to closely receive the upstanding finger 47 in a locking relationship. The compression spring 48 exerts a force against the bolt 46 which keeps the finger 47 in the locked position within the groove 49 once the finger 47 is received therein. When the finger 47 is withdrawn from the groove 49, and the keeper flange 54 is swung out of alignment with the anvil portion 70, the finger 47 will be urged towards and rest against the bore 58 until such time as it is again aliigned with the groove 49. The alignment of these two elements only occurs when the keeper flange 54 is positioned directly above the anvil portion 70. FIG. 2 is a cross-sectional view of the lock when in its fully locked position, the finger 47 being nestled in the bolt receiving pocket 52, with the spring 48 being extended as seen in FIG. 3. In FIG. 2A, the bolt 46 is retracted and the spring 48 is compressed, such that finger 47 mates with groove 49. This is the partially telescoped and unlocked position. However, in this position, the finger 47 continues to be retained in the groove 49.

When the lock housing 26 is seated in the barrel assembly 28 (see FIG. 1) a guide stem 74 which is affixed to the distal end of the lock housing 26 protrudes through the washer portion 68. A split snap ring 76 snaps into a groove 78 on the stem 74 to securely retain the lock housing 26 within the barrel assembly 28. A helical compression spring 80 has one end anchored against the closure plate 66 and its other end against the lock housing 26. This exerts a force against the lock housing 26 which causes the lock housing 26 and its associated keeper flange 54 to be pushed away from the anvil portion 70. This movement is restricted by the locking bolt 46 when it is engaged in the bolt receiving pocket 52.

The keeper lock of the present invention operates very simply and is extremely convenient for the user. The user inserts the tubular key 36 into the channel 34 with the key tab 38 properly aligned with the keyway 40. The key 36 is rotated causing the eccentric pin 42 to rotate and withdraw the bolt 46 from the bolt receiving pocket 52. As the bolt 46 clears the slot 50 in the sidewall, the compression spring 80 pushes the lock housing 26 axially away from the anvil portion 70. With the key 36 in the rotated position the bolt 46 will continue to be drawn into the lock housing 26 and the upstanding finger 47 will be withdrawn from the groove 49. The keeper flange 54 is separated from the anvil portion 70 a sufficient amount to permit the sliding element 18 to enter or be withdrawn from its captive position between the retainer flanges 72.

However, it is easier for the operator to place the sliding element 18 between the retainer flanges 72 or remove it therefrom if the keeper arm 54 is rotated to a laterally removed position with respect to the anvil thereby rendering the sliding element completely uncovered for ease of manipulation. With the upstanding finger 47 removed from the groove 49 the keeper flange 54 can be rotated to this out-of-the-way position. It should be noted that when the locking bolt 46 is withdrawn from the pocket 52 the spring 80 causes the keeper flange 54 to pop up and away from the anvil 70. The split snap ring 76 will restrain the lock housing 26 from being completely removed from the barrel assembly 28. Thus, the lock housing 26 assumes a partially telescoped and unlocked position.

With the keeper flange 54 swung to one side, the operator can still remove the tubular key 36. The lock can be left in this position or, with the key removed, the keeper arm can again be rotated so that it directly overlies the anvil portion 70. The compression spring 48 maintains a constant force against the bolt 46 and the upstanding finger 47 will engage the groove 49. Thus, the keeper flange 54 has now assumed an intermediate partially telescoped and unlocked position wherein the keeper arm directly overlies the anvil portion 70 but is spaced apart from it. The keeper flange 54 is not free to angularly rotate as it is now restrained from such movement due to the finger 47 engaging the groove 49. However, in this position, the sliding element 18 can still be carefully slid between the keeper flange 54 and anvil portion 70 due to a sufficient gap between the two elements. In order to place the lock in its fully telescoped locked position wherein the keeper flange 54 will closely overlie the anvil portion 70 in a locking relationship with the sliding element 18 being restrained from removal by the retainer flanges 72, the keeper flange 54 need only be pushed down axially towards the anvil portion 70. The shoulders 56 of the keeper flange 54 will be in alignment to clear the walls 62 of the rim flange 60. As soon as the bolt 46 clears the slot 50 in the sidewall it will be lockingly received by the pocket 52.

The tubular lock assembly 30 is designed so that the key 36 can be removed from the channel 34 when the keeper arm 54 is in any of its three positions, i.e. the fully telescoped and locked position with the keeper arm 54 closely overlying the anvil with the slide fastener confined between the two, the intermediate partially telescoped and unlocked position with the keeper arm overlying the anvil but spaced apart therefrom, and the partially telescoped and unlocked position with the keeper arm swung to one side of the anvil so that it is laterally removed with respect to the anvil for meeting easy access of the slide fastener for manipulation.

As can readily be seen, the positioning of the upstanding finger 47 with respect to the groove 49 must be thoroughly precise such that the keeper flange 54 will be accurately positioned with respect to the anvil portion 70 when the finger 47 engages the groove 49. It can readily be seen that with the lock in the partially telescoped and unlocked position with the keeper arm overlying the anvil, all that is required by the user is to axially push the keeper flange 54 towards the anvil portion 70 in order to place the lock in its fully telescoped and locked position. This makes it extremely convenient and simple for the user of these locking mechanisms.

Thus it is apparent that there has been provided, in accordance with the invention, an improved keeper lock mechanism for zipper-type slide fasteners that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. In a keeper lock for a zipper-type slide fastener the lock including a barrel assembly of a tubular barrel and an anvil fixed to and projecting radially from the barrel, the anvil adapted to receive the slide fastener when the fastener is moved to its closed position, a key operated lock assembly telescopically and rotatably received in the barrel for limited acial sliding movement therein and a keeper arm fixed to and projecting radially from the lock assembly adjacent to a proximal end thereof, the lock assembly and keeper arm being capable of both angular rotation and axial movement so that it may assume a fully telescoped locked position wherein the keeper arm closely overlies the anvil for confining the slide fastener between the keeper arm and the anvil, an intermediate partially telescoped and unlocked position wherein the keeper arm overlies the anvil and is spaced apart therefrom, and a partially telescoped and unlocked position wherein the keeper arm is swung to one side so that it assumes a laterally removed position with respect to the anvil so that the slide fastener is accessible for manipulation, a locking bolt carried by the lock assembly and adapted for locking engagement with the barrel when the lock assembly assumes the fully telescoped locked position to maintain the lock assembly in the locked position, a lock cylinder in the lock assembly and movable between locked and unlocked positions, and a key and tumbler mechanism for controlling the operation of the cylinder, the lock cylinder, when in its unlocked position, serving to withdraw the locking bolt from its locking engagement with the barrel, the improvement comprising: alignment means for positioning the keeper arm over the anvil when the keeper arm is in the intermediate partially telescoped and unlocked position so that the keeper arm can assume the fully telescoped and locked position by pushing the keeper arm axially towards the anvil, said alignment means comprising a protruding finger carried by the lock assembly and a receiving groove portion in the barrel, the receiving groove portion adapted to receive in locking relationship the protruding finger when the keeper arm is rotated to a position overlying the anvil, said protruding finger being engaged by spring means for pushing the finger radially outward against the barrel, the finger operatively connected to the key operated lock assembly so that operation of the key and tumbler mechanism causes withdrawal of the finger from engagement with the groove portion in the barrel.

2. The keeper lock of claim 1 and further comprising a tab portion on the key and keyway means on the lock cylinder interfacing with the tab portion for preventing removal of the key until the key is rotated and the tab portion is in alignment with the keyway means.

3. The keeper lock of claim 2 and further comprising means in the lock cylinder for permitting rotation of the key when inserted for engagement with the tumbler mechanism whereby the key can be rotated and removed from the lock assembly regardless of the position of the keeper arm.

4. The keeper lock of claim 3 wherein the lock assembly is a tubular lock and the key is a cylindrical key adapted to be received by the tubular lock.

5. The keeper lock of claim 1 wherein the alignment means comprises an upstanding protruding finger extending radially outward from the locking bolt and a groove portion in the barrel adapted to receive inlocking relationship the protruding finger when the keeper arm is rotated to a position overlying the anvil.

6. The keeper lock of claim 5 wherein the protruding finger is engaged by spring means for pushing the finger radially outward against the barrel, the finger operatively connected to the key operated lock assembly so that operation of the key and tumbler mechanism causes withdrawal of the finger from engagement with the groove portion in the barrel.

7. The keeper lock of claim 6 and further comprising a tab portion on the key and keyway means on the lock cylinder interfacing with the tab portion for preventing removal of the key until the key is rotated and the tab portion is in alignment with the keyway means.

8. The keeper lock of claim 7 and further comprising means in the lock cylinder for permitting rotation of the key when inserted for engagement with the tumbler mechanism whereby the key can be rotated and removed from the lock assembly regardless of the position of the keeper arm.

9. The keeper lock of claim 8 wherein the lock assembly is a tubular lock and the key is a cylindrical key adapted to be received by the tubular lock.

* * * * *